US007052252B2

(12) United States Patent
Hunsberger

(10) Patent No.: US 7,052,252 B2
(45) Date of Patent: May 30, 2006

(54) PORT CONFIGURATION FOR FUEL PUMP UNIT FOR FACILITATING PRESSURE FEEDBACK

(75) Inventor: Dale L. Hunsberger, Rockford, IL (US)

(73) Assignee: Suntec Industries Incorporated, Glasgow, KY (US)

( * ) Notice: Subject to any disclaimer, the term of this patent is extended or adjusted under 35 U.S.C. 154(b) by 390 days.

(21) Appl. No.: 10/461,152

(22) Filed: Jun. 13, 2003

(65) Prior Publication Data

US 2004/0253119 A1 Dec. 16, 2004

(51) Int. Cl.
*F04B 17/00* (2006.01)

(52) U.S. Cl. ..... 417/410.4; 417/410.3; 417/220; 417/310

(58) Field of Classification Search ..... 417/410.4, 417/410.3, 220, 310
See application file for complete search history.

(56) References Cited

U.S. PATENT DOCUMENTS 3,566,901 A 3/1971 Swedberg
4,628,871 A * 12/1986 Glass ..... 123/25 B
4,683,854 A * 8/1987 Goulet ..... 123/435
5,145,328 A * 9/1992 Harwath ..... 417/299
5,346,174 A 9/1994 Harwath
5,368,068 A 11/1994 Hunsberget et al.
5,692,680 A * 12/1997 Harwath et al. ..... 239/127
6,170,470 B1 * 1/2001 Clarkson et al. ..... 123/497
6,446,610 B1 * 9/2002 Mazet ..... 123/497

OTHER PUBLICATIONS

SUNTEC *Components for Oil Burners* Sales Literature, compilation dates ranging from Jun., 1993 to Feb., 2001, 56 pages.

* cited by examiner

*Primary Examiner*—Charles G. Freay
*Assistant Examiner*—Ryan Gillan
(74) *Attorney, Agent, or Firm*—Reinhart Boerner Van Deuren P.C.

(57) ABSTRACT

An oil pump unit includes an additional outlet port connected to the downstream side of the pump through the pump cover. With this additional port, the oil pump unit is able to have electronic vacuum and pressure sensors upstream and downstream of the pump for remote monitoring of the pump. The invention is particularly suited for oil pump units which have a main discharge outlet port through the one side of the pump body and a main inlet port through an opposing side of the pump cover. The invention is also particularly suited for oil pump units having a solenoid valve mounted at the top side of the pump body which prevents installation of a pressure sensor along the top side.

7 Claims, 4 Drawing Sheets

PORT CONFIGURATION FOR FUEL PUMP UNIT FOR FACILITATING PRESSURE FEEDBACK

FIELD OF THE INVENTION

This invention pertains to fuel pumps, and more particularly to port configurations of fuel pumps having a pump body and a cover.

BACKGROUND OF THE INVENTION

Fuel oil pump units are used to pump fuel oil to oil burning furnaces for heating residential and commercial buildings. By virtue of the application and where furnaces are located, fuel oil pump units often are required to fit a small confined area of a predetermined package size. Examples of fuel oil pump units are disclosed in U.S. Pat. Nos. 3,360,190; 3,446,230; 3,446,231; 3,446,232; 3,566,901; 4,021,155; 4,171,939; 4,255,093; 4,391,580; 4,685,871; 4,728,271; 4,856,553; 4,858,884; 4,898,523; 4,958,997; 5,145,328; 5,316,457; 5,346,174; and 5,692,680, and application Ser. Nos. 10/017,153 and 10/115,742, all assigned to the present assignee, and all of which are hereby incorporated by reference in their entireties.

As disclosed in these patents and patent applications, the basic structural design for an oil pump unit typically comprises a pump body often formed of cast iron and a pump cover often formed of aluminum. The pump body typically contains a crescent type gear pump that pumps fuel oil from a local reservoir (defined between the pump body and pump cover) that is supplied oil from a fuel oil storage tank. The pump unit also comprises a fuel regulator that is adapted to regulate flow of fuel oil from the gear pump to a nozzle outlet passage. The nozzle outlet passage is adapted to be connected to the combustion chamber of a furnace.

To a large extent, this basic structural design has remained the same and has provided excellent reliability, low cost and other desirable characteristics. The present assignee, Suntec® Industries, has manufactured and continues to manufacture a number of different commercially successful models of oil pump units incorporating this basic structural design.

Many years ago, most oil pump units had a mechanically actuated fuel regulator (e.g. such as a pressure sensitive diaphragm valve which is used to control the opening and closing of the regulator). However, many of the more modern designs (which have retained the basic structural design of mechanically controlled regulators) now incorporate electronic control of the regulator, such as may be provided an electrically actuated solenoid valve. As a result of this trend, many current Suntec® models of fuel oil pump units now incorporate a solenoid valve. The solenoid valve is typically mounted on the top side of the pump body which is often the most convenient location to provide for control over the fuel regulator. Because solenoid control based designs have been in existence for a number of years, there is a large number of existing Suntec® oil pump units having solenoid valve control that are currently employed in the field.

As will be readily appreciated by maintenance and service technicians in the industry, oil pump units must be replaced or repaired from time to time due to normal wear and usage. Because existing applications need to be serviced and replaced from time to time, any design changes to an existing model of an oil pump unit typically require a pump unit configuration with about the same package size in order to properly fit into the available space for existing applications. Also, the oil pump unit must typically provide the same port configuration to provide for ready connection to the existing furnace and supply line plumbing.

The next future trend in the fuel oil heating industry will likely be to provide smart feedback to oil pump unit and furnace systems. Sensors may be employed to monitor various burner parameters such as pressures, temperatures and flame brightness. From this feedback, it can be determined if the oil pump unit is operating properly. The data will be transmittable to remote locations (e.g. via phone lines) for remote monitoring by service technicians who normally service and maintain oil pumps units and associated furnaces. To accommodate this trend, systems will need to incorporate a pressure sensor and a vacuum sensor.

Some models of oil pump units already have two inlet side ports upstream of the gear pump and two outlet ports downstream of the gear pump. With extra ports already provided in this configuration, these models of oil pump units can readily accommodate a vacuum sensor on the inlet side and a pressure sensor on the outlet side. However, many models of oil pump units do not provide an extra outlet side port to accommodate a pressure sensor. This presents a problem since as discussed above, the existing package size, design and port configuration can not readily be changed due to the need to accommodate existing applications, which often require a given package size and port configuration.

One solution conceived by the present inventor is to provide an additional outlet pressure port along the top side of the pump body to accommodate a pressure sensor. This may provide a solution for oil pump models that are mechanically controlled solely through diaphragm valves (i.e. models without solenoid valves). However, in solenoid valve type models, the solenoid valve is typically mounted to the top side of the pump body. Therefore, in designs incorporating solenoid valves such as Suntec® model nos. A2EA-6520, A2VA-3006 and A2VA-5006, there is not room to provide an additional port to receive a pressure sensor along the top side of the pump body. A potential and previously unknown solution to this issue which has been conceived by the present inventor is to provide an external connection in the plumbing such as providing a t-section in the external copper tubing that connects to the single nozzle outlet provided by oil pump unit. However, this location is somewhat inaccessible when the burner is mounted to the appliance (boiler or furnace). This also would increase the cost and number of parts for oil burner systems.

BRIEF SUMMARY OF THE INVENTION

The present invention provides a solution to the problems presented in the art as discussed above by providing an additional outlet port connected to the downstream side of the pump through the pump cover. The present invention is particularly suited for oil pump units which have a main discharge or outlet port through the one side of the pump body and a main inlet port through an opposing side of the pump cover (e.g. left and right sides when viewed from the front). The present invention is also particularly suited for oil pump units having a solenoid valve mounted at the top side of the pump body which prevents installation of a pressure sensor along the top side. The new pressure port may be defined through the front side of the pump cover and connected through a passageway formed at least in part by the pump cover to the downstream side of the pump. This provides an accessible location for mounting of a pressure sensor for remote monitoring.

It is an advantage of the present invention that existing models and designs of oil pump units can be redesigned to include this additional port without having to change the pump unit package size or the existing port configuration. Thus, the present invention provides for an additional operation feature while keeping the existing pump unit configuration such that the pump unit and its parts continue to be suitable as a replacement unit for existing applications in the field.

Other aspects, objectives and advantages of the invention will become more apparent from the following detailed description when taken in conjunction with the accompanying drawings.

DETAILED DESCRIPTION OF THE INVENTION

Figure 1:
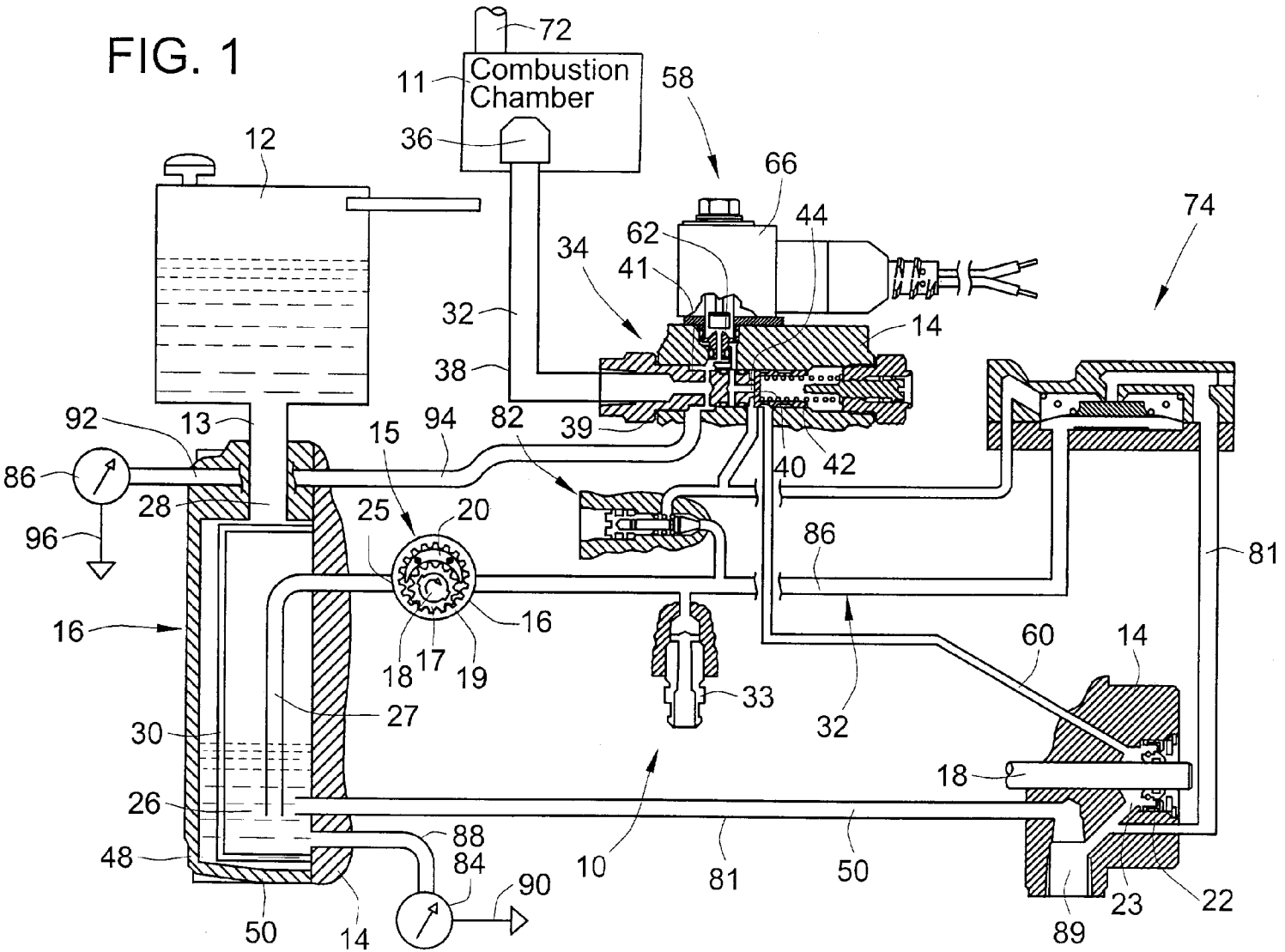
FIG. 1 is a schematic representation of a oil pump unit incorporated in a oil pumping system for a furnace or boiler, in accordance with a preferred embodiment of the present invention.

As shown in the drawings, the invention is embodied in a fuel oil pump unit 10 of the type used to supply fuel to the combustion chamber 11 of a burner such as might be incorporated into a furnace or boiler. The unit 10 includes a gear pump 15 that draws fuel oil or other suitable fuel from an oil supply such as a tank 12 through an intake line 13.

The gear pump 15 is contained within a pump housing that is comprised of a pump body 14 (preferably made of cast iron) and a pump cover 16 (preferably made of aluminum). The pump cover 16 is bolted to the pump body 14. The gear pump 15 is illustrated as the conventional crescent type and includes an inner gear 17 within the housing that is attached to a drive shaft 18 and that is eccentrically disposed with respect to an outer gear 19. A crescent-shaped member 20 is disposed between the non-engaging portions of the teeth on the gears for the purpose of sealing the expanding fluid chambers defined by the gears from the contracting fluid chambers in a well known manner.

The pump shaft 18 is journalled in the pump body 14 and is sealed with respect thereto by an elastomeric sealing member which herein is shown in the form of a lip seal 22. The lip seal 22 is disposed within and seals off a lubrication chamber 23 in the housing.

The pump 15 includes an inlet side that communicates with a local fuel oil reservoir 26 that receives fuel oil from the main oil supply or tank 12. The pump cover defines an inlet port 28 to which the intake line 13 (often provided by copper tubing) from the storage tank 12 may be connected. The local fuel oil reservoir 26 is defined in a chamber formed between the pump body 14 and the pump cover 16. More specifically, the pump cover 16 includes a front side 48 and a rearwardly extending sidewall 50 that spaces the front side 48 forward of the pump body 14 and that encloses the fuel reservoir 26. Along the inlet side, the pump 15 includes a pump inlet 25 that is connected by an inlet passage 27 through the pump body 14 to the reservoir 26.

A suitable strainer 30 may be located within the reservoir 26 between the inlet port 28 and the pump inlet 25 to filter the fuel oil as it is drawn from the tank to the pump 15. The pump 15 pressurizes the fuel oil and outputs fuel into an outlet passage 32 along the downstream side of the pump 15. A bleed valve 33 may be disposed along the outlet passage 32. The outlet passage 32 ultimately delivers fuel oil to a main regulating valve assembly 34 that serves to regulate the pressure of fuel oil and causes fuel flow to the burner 36 to be of a substantially constant pressure.

The regulating valve assembly 34 is located in the pump body 14 and serves to control the fuel flow from the outlet passage 32 to an outlet port 41 defined by the pump body 41. A fitting 39 may be mounted into the outlet port 41 of the pump body 14. Copper tubing 38 or other suitable conduit means is mounted to the fitting 39 to connect the outlet port 41 of the pump body 14 to the burner 36.

The fitting 39 also provides a valve seat 40 for the regulating valve assembly 34. The valve seat 40 is adapted to be closed by a spring biased hollow piston 42. The piston 42 is slidably mounted in a pressure chamber 44 and is spring biased to regulate fuel flow entering the chamber 44.

The opening and closing of the regulating valve assembly 34 is controlled with a solenoid valve 58 that is mounted to the top side of the pump body 14. As shown herein, the solenoid valve 58 is of the blocking type, but it alternatively may be of the bypassing type or other suitable control arrangement. The solenoid valve 34 controls opening of the regulating valve assembly 34 (i.e., the outlet port of valve assembly 34) to the outlet passage 32 upon startup and controls closing of the regulating valve assembly 34 upon shut down. The solenoid valve 58 includes an electrical control element 66 drives a movable valve element 62 between open and closed states to cause pressure to build or be relieved such that the spring biased piston 42 either opens or closes a bypass passage 60 that recirculates fuel to either the tank 12 or local reservoir 26.

The electrical control element 66 may include a thermistor providing a desired time delay for switching the solenoid valve between states. Alternatively, an electronic control (not shown) for the burner may provide the means to control activation of the solenoid control element. In either event, a delay is typically provided in order to provide sufficiently high pump speed and fuel pressure; and also to allow the speed of the blower (not shown), which is driven by the same shaft 18 as the pump 15 to be sufficient to establish a good draft up the chimney 72 of the burner 36.

The disclosed embodiment may also or alternatively include a diaphragm valve 74 or other similar bypass mechanism arranged in parallel circuit with the first bypass mechanism of the solenoid valve 58 and/or the regulating valve assembly 34. In the disclosed embodiment, the diaphragm valve serves as a redundant backup to the solenoid valve 58 to better ensure the proper opening of the fuel regulating valve assembly 34 at an appropriate time. Such a redundant bypass arrangement is disclosed in patent application Ser. No. 10/017,153 filed on Dec. 14, 2001. The diaphragm valve 74 causes the pump 15 to reach a high start-up rpm before the regulating valve assembly 34 opens and causes the regulating valve assembly 34 to close after the pump 15 falls below a certain rpm upon shutdown. The diaphragm valve 74 is adapted to open or close a second return passage 81 leading back to the pump reservoir 26 (or alternatively to the tank 12). To provide for proper operation of the diaphragm valve, a cone valve 82 is arranged upstream of the diaphragm valve to provide a restriction and pressure drop that determines when the diaphragm valve 74 closes the second return passage 81.

As long as the speed of the pump 15 is relatively low, the diaphragm valve 74 remains open to prevent a build up of pressure in the chamber 44 of the regulating valve assembly 34 sufficiently such that the regulating valve assembly 34 remains closed via the spring biased piston 42. However, as the pump speed increases, the increased flow past the cone valve 82 causes a pressure differential in the diaphragm valve to overcome the force of a spring and close the diaphragm valve causing all of the fuel flow to flow from the pump 15 through the outlet passage of the pump body 14 to the regulating valve assembly 34.

In the disclosed embodiment, the diaphragm valve 74 acts as a back up for the solenoid valve 58 to better ensure that smoking or soot production does not occur in the combustion chamber 11. The regulating valve assembly 34 remains closed as long as either the diaphragm valve 74 remains open or the solenoid valve 58 remains closed , thereby causing the piston 41 to be wide open and cause flow to bypass along bypass passage 60. The regulating valve assembly 34 opens and outputs fuel to the furnace only after the diaphragm valve 74 closes and the solenoid valve 58 opens. Once this happens (which is typically very quickly), all of the fuel flow is pumped by the gear pump 15 through the outlet passage 32 and the outlet port 41.

In accordance with the present invention, the oil pump unit 10 provides a port arrangement that substantially maintains size package of prior solenoid type models, while also accommodating inlet side and outlet side electronic pressure gauges 84, 86. As is evident from the foregoing, one inlet port 28 is provided to receive fuel from the tank 12, and one outlet port 41 is provided to output pressurized fuel to the burner 36.

To accommodate the inlet side electronic pressure gauge 84 at least one additional inlet side port 88 is provided in the bottom side of the pump body 14. The inlet side port 88 is constantly in fluid communication with the local reservoir 26 and subject to the pressure experienced in the local reservoir 26 upstream of the pump 15. As a result, the pressure experienced at the inlet side pressure gauge 84 is the vacuum pressure that is upstream of the pump 15. The inlet side pressure gauge 84 provides electronic feedback representing sensed vacuum pressure on an electrical line 90 which may be transmitted via telephone lines or a wireless transmitter to a remote location. Such data that is transmitted over the electrical line 90 is indicative of whether the oil pump unit 10 is properly operating.

To accommodate the outlet side electronic pressure gauge 86, an outlet side port 92 is formed into the front side of the pump cover 16. Because the pump cover 16 is upstream of the pump 15, a formed passage 94 is provided through the pump cover 16 and the pump body 14 that bypasses the reservoir 26 to be in direct fluid communication with the outlet port 41 on the downstream side of the pump 15 and downstream of the solenoid valve 58. With this arrangement, the outlet side port 92 is in constant communication with the pressure generated by the pump 15 when the solenoid valve 58 is open. With the given arrangement, downstream of the solenoid valve 58, the outlet side pressure gauge 86 will also indicate if the solenoid valve and regulating valve assembly are properly operating. The outlet side pressure gauge 86 is mounted into the outlet side port 92 and provides electronic feedback on an electrical line 96. The pressure gauge data on electrical line 96 may be transmitted on telephone lines or a wireless transmitter to a remote location.

The data from the pressure gauges 84, 86 can be used at a remote location to determine whether the oil pump unit 10 is properly operating. If the data indicates a problem, a service technician can be sent to maintenance, repair or replace the oil pump unit 10. The source of the problem might be also be indicated by the gauges 84, 86 such that the service technician can anticipate the solution and be prepared during a maintenance visit.

Figure 2:
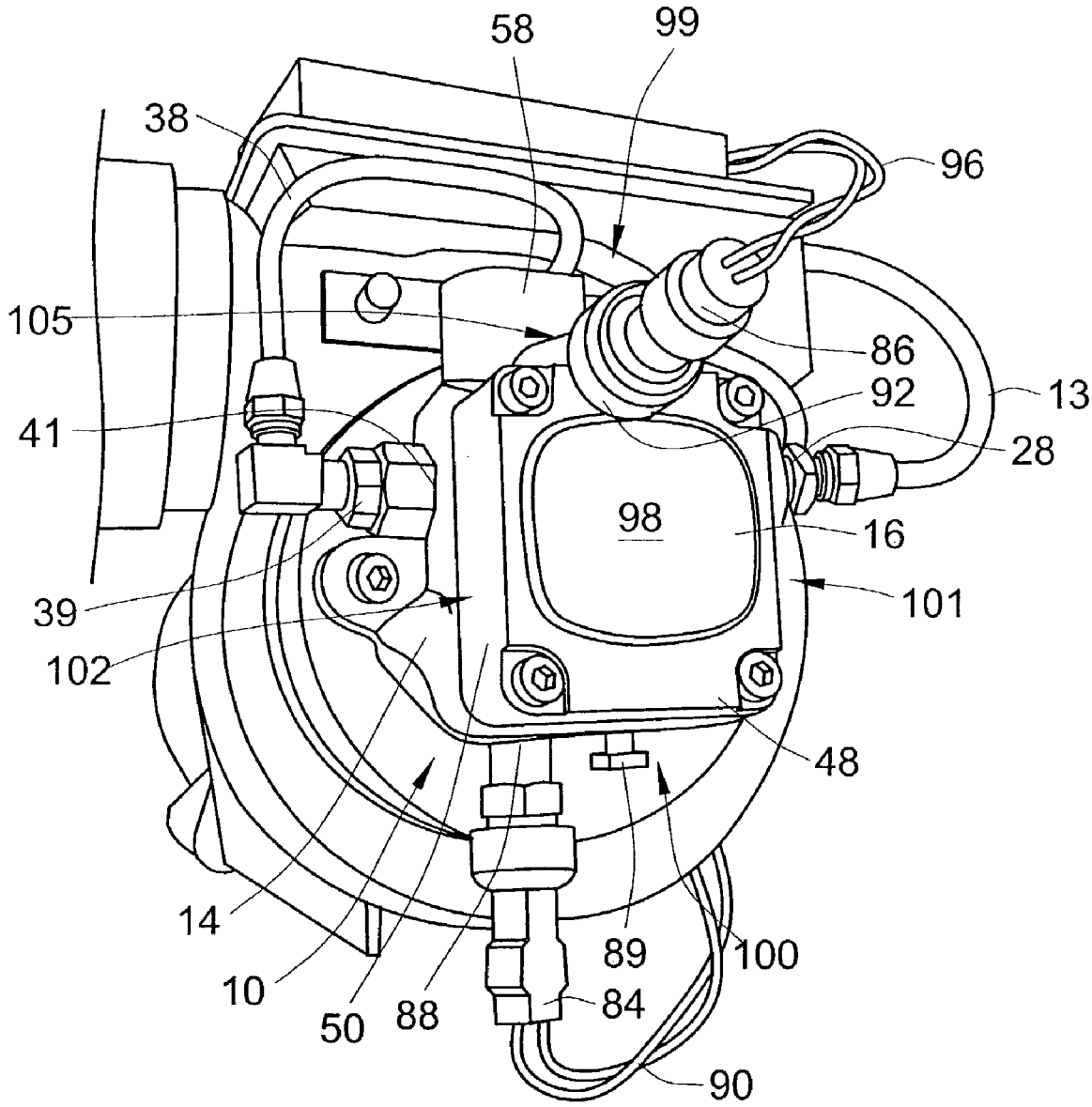
FIG. 2 is a perspective view of the oil pump unit shown in FIG. 1 as it is hooked up to a burner according to an embodiment of the present invention.
Figure 3:
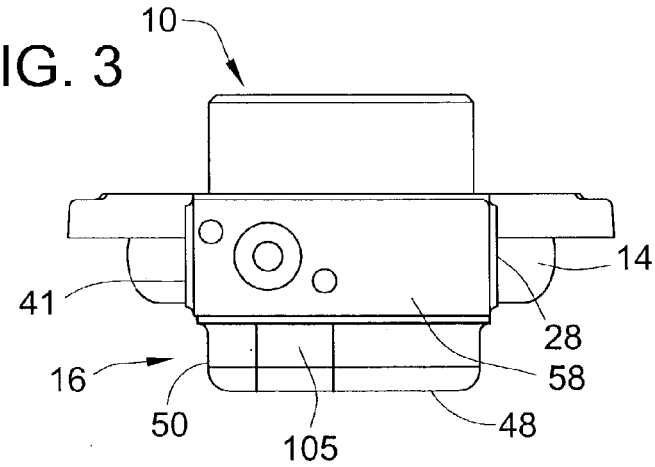
FIG. 3 is a top view of the oil pump unit shown in FIG. 1.
Figure 4:
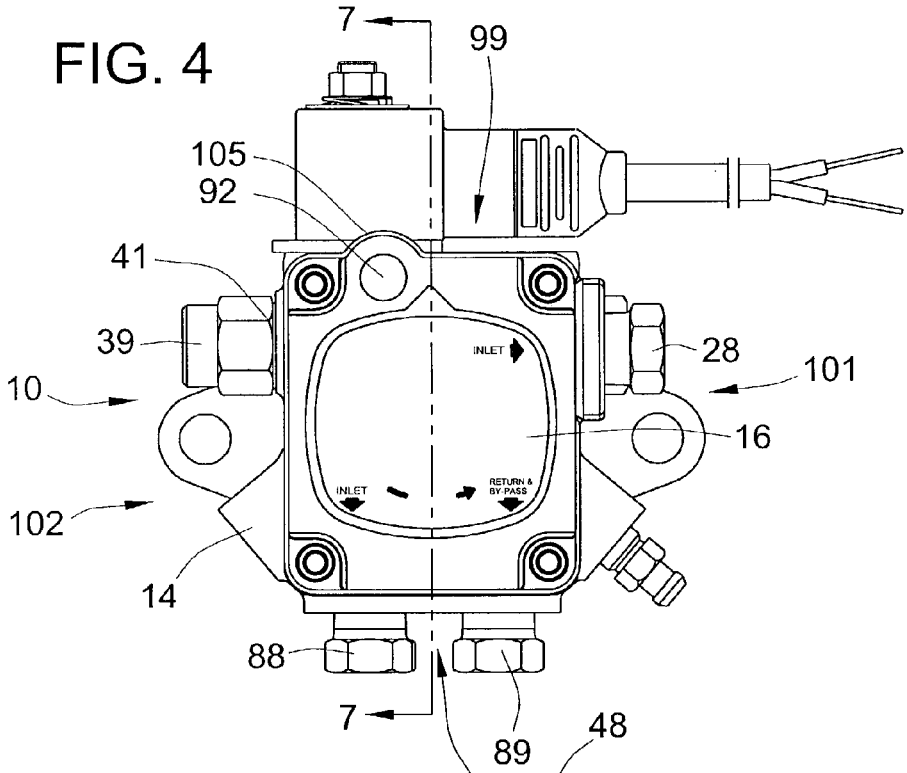
FIG. 4 is a frontal view of the oil pump unit shown in FIG. 2.
Figure 5:
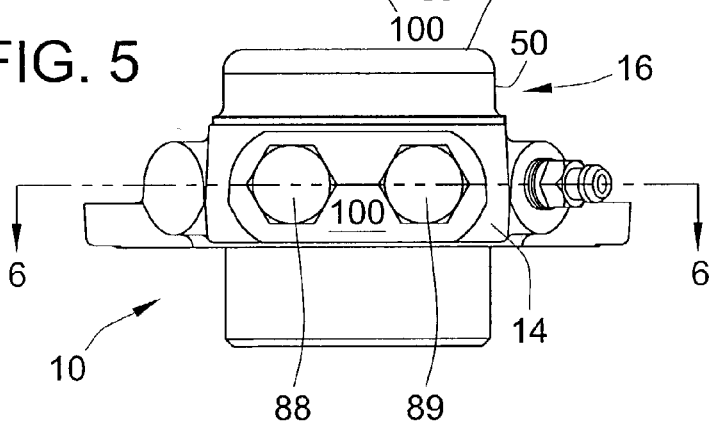
FIG. 5 is a bottom view of the oil pump unit shown in FIGS. 2 and 4.
Figure 7:
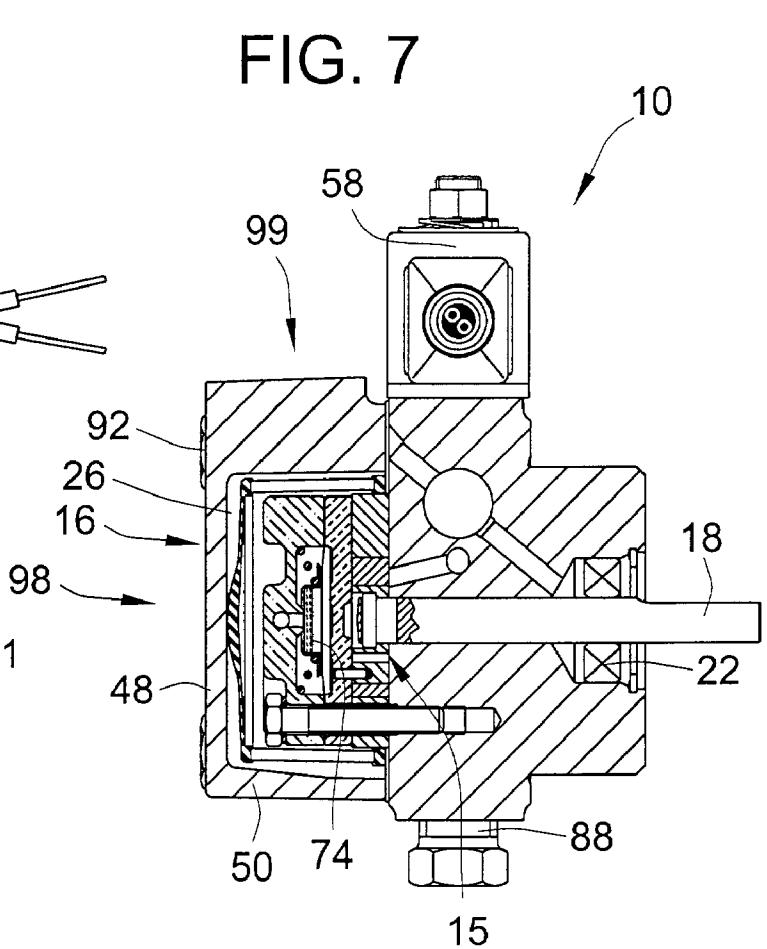
FIG. 7 is a cross section of FIG. 4 taken about line 7—7.
Figure 6:
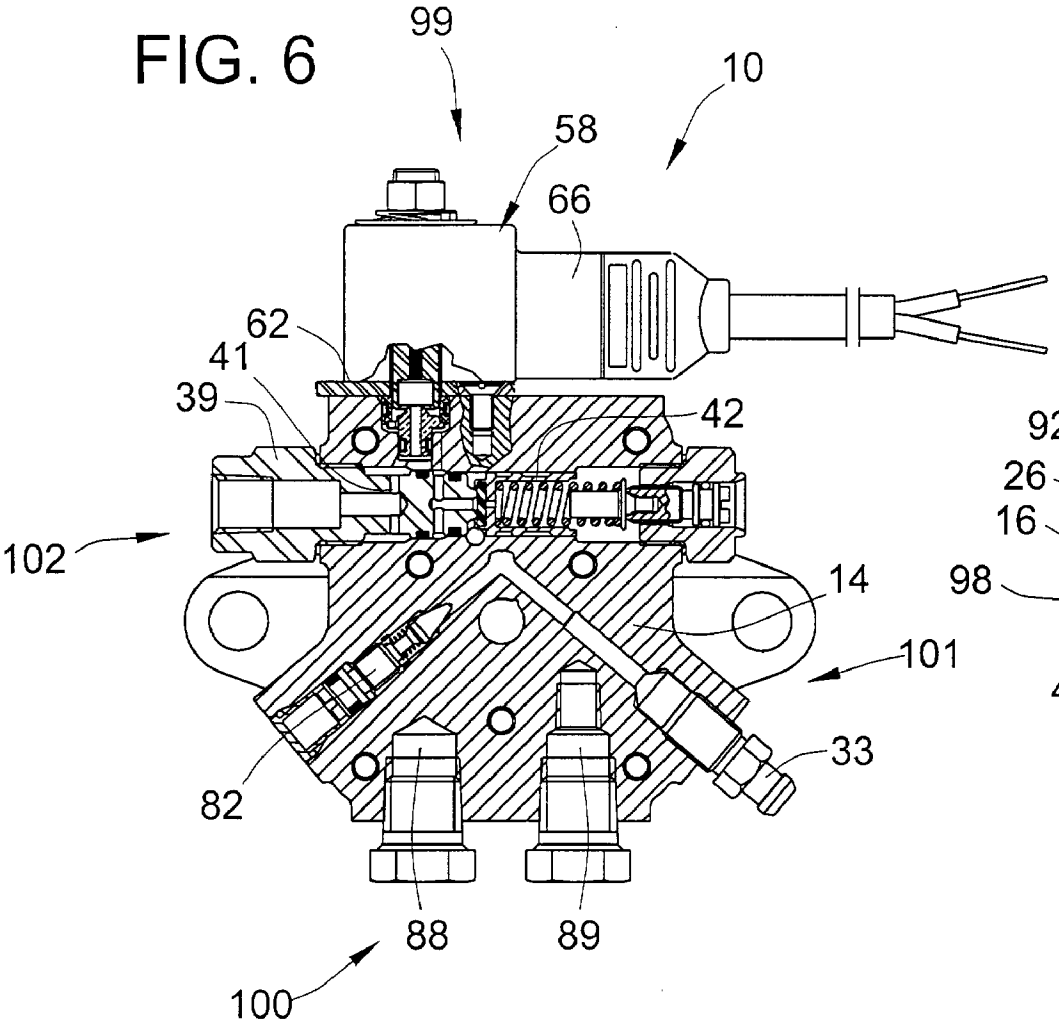
FIG. 6 is a cross section of FIG. 5 taken about line 6—6 with a different type of regulating valve shown in comparison to FIG. 1.

The illustrated pump unit 10 also provides a port arrangement that is suitable for use with existing applications. For purposes of orientation, and as shown in FIGS. 2–5, a front side 98 of the fuel pump unit 10 is provided by the pump cover 16. With this orientation, the pump unit 10 has a top side 99, a bottom side 100, a right side 101, and a left side 102. The main fuel inlet port 28 is provided along the right side 101 of the pump unit 10 in the pump cover 16, and is in a conventional position to connect to existing tank intake lines (e.g. such as intake line 13 as shown) without additional plumbing. Likewise, the main fuel outlet port 41 is on the left side of the pump unit 10 in the pump body 14, and is in a conventional position to connect to existing outlet passage conduits (e.g. tubing 38) without additional plumbing. The inlet side port 88 formed in the bottom side 100 (adjacent a return port 89 that provides an option of connecting to the tank 12) receives the electronic inlet side pressure gauge 84. Because the solenoid valve 58 occupies the top side of the pump body 14, the other pressure gauge 86 is mounted into the front side 98 of the pump unit 10 through the outlet side port 92 formed into the front side of the pump cover 16. To accommodate the outlet side port 92 and communicating pressure passage 94, the pump cover 16 may include a raised boss or projection 105 to ensure sufficient material is provided to form the port 92 and passage 94.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fuel pump unit for pumping fuel from a fuel tank to a combustion chamber, comprising:

a pump body;

a shaft driven gear pump in the pump body adapted to pump fuel from an upstream fuel network to a downstream fuel network;

a pump cover mounted to the pump body, the pump cover having a front wall and a sidewall spacing the front wall from the pump body;

a local reservoir defined between the pump body and the pump cover;

a first inlet side port upstream of the gear pump in fluid communication with the local reservoir, the first inlet side port being defined by the sidewall of the pump cover;

a second inlet side port upstream of the gear pump in fluid communication with the local reservoir, the second inlet side port being defined by the pump body;

a first outlet side port downstream of the gear pump in fluid communication with the downstream fuel network, the first outlet side port being defined by the pump body;

a fuel regulating valve with open and closed positions for controlling flow of the fuel to the downstream network; and a second outlet side port downstream of the gear pump in continuous fluid communication with the downstream fuel network when the fuel regulating valve is in the open position and when the fuel regulating valve is in the closed position, the second outlet side port being defined externally by the pump cover.

2. The fuel pump unit of claim 1, further comprising a solenoid valve mounted to a top side of the pump body preventing installation of a pressure sensor to the top side of the pump body, the solenoid valve controlling opening and closing the fuel regulating valve.

3. The fuel pump unit of claim 2, wherein the second outlet side port is in fluid communication with a downstream side of the solenoid valve.

4. The fuel pump unit of claim 1, further comprising a pressure communication passage defined in part by the pump cover and in part by the pump body, the pressure communication passage fluidically connecting the second outlet side port to the downstream fuel network.

5. The fuel pump unit of claim 1, further comprising an electronic pressure sensor mounted to the second outlet side port.

6. The fuel pump unit of claim 5, further comprising an electronic vacuum sensor mounted to the second inlet side port, wherein the first inlet side port is connected to a fuel supply line leading to the tank and wherein the first outlet side port is connected to the combustion chamber.

7. The fuel pump unit of claim 1, wherein the fuel pump unit includes a top side, a bottom side, a right side and a left side when viewed from the front side of the pump cover, wherein the second outlet side port is through the front side of the pump cover, the second inlet side port is through the pump body along the bottom side, the first inlet side port is through the pump cover along the right side, and wherein the first outlet side port is through the pump body along the left side.

* * * * *